US005080430A

United States Patent [19]

Castro

[11] Patent Number: 5,080,430

[45] Date of Patent: Jan. 14, 1992

[54] RECLINING CHAIR

[75] Inventor: Bernard Castro, Ocala, Fla.

[73] Assignee: Castro Convertible Corporation, New York, N.Y.

[21] Appl. No.: 588,071

[22] Filed: Sep. 25, 1990

[51] Int. Cl.[5] ..... A47C 1/036

[52] U.S. Cl. ..... 297/61; 297/114; 297/403

[58] Field of Search ..... 297/61, 68, 112, 403, 297/408, 114

[56] References Cited

U.S. PATENT DOCUMENTS

| | | | |
|---|---|---|---|
| 4,451,081 | 5/1984 | Kowalski | 297/61 |
| 4,691,961 | 9/1987 | Rogers, Jr. et al. | 297/61 |
| 4,865,388 | 9/1989 | Nemoto | 297/403 |

FOREIGN PATENT DOCUMENTS

| | | | |
|---|---|---|---|
| 2750103 | 5/1979 | Fed. Rep. of Germany | 297/408 |

*Primary Examiner*—Peter R. Brown

*Attorney, Agent, or Firm*—Fitzpatrick, Cella, Harper & Scinto

[57] ABSTRACT

A reclining chair has a headrest upholstered directly to the front edge of the back of the chair which is automatically adjustable with respect to each of the positions of the reclining chair. The headrest is adapted to move between a position wherein it lies generally flat rearwardly of the back and a position wherein the headrest swings forwardly into a position to comfortably support the user's neck. In order to coordinate movement of the headrest between the positions of the chair, the chair includes a contoured moveable rear support member.

18 Claims, 4 Drawing Sheets

RECLINING CHAIR

BACKGROUND OF THE INVENTION

This invention relates to a reclining chair, and more particularly, to a moveable headrest for a reclining chair.

A reclining chair is one in which a person can sit upright, as in an ordinary lounge chair, or can lean back thereby moving the back and seat of the chair to a semi-horizontal position. Most reclining chairs also have a moveable footrest which, when the chair is shifted to a reclined position, swings upwardly to support a person's feet. In various recliners, a stationary headrest is integrally formed with the back cushion of the recliner. These stationary headrests have been found to be uncomfortable and to cause unwarranted neck strain when the user is in a reclined position for a prolonged period of time.

Attempts have been made in the past to provide a headrest which moves adjacent to the back when the chair is in a reclined position, and alternatively, to be moved remote from the seat back when the chair is in its generally upright position. Such headrests for a reclining chair are disclosed in U.S. Pat. Nos. 2,514,655 to Luketa, 2,976,915 to Spound, 3,179,477 to Garrett and 4,691,961 to Rogers, Jr. et al. These movable headrests, however, are not designed to comfortably support the user's neck, and accordingly, the possibility of neck strain is reduced. Moreover, in each of these references, intricate gearing arrangements are provided to move the headrest between a position remote from the seat back to its useable position, thus increasing the manufacturing costs of the recliner. Further, these headrests are not automatically adjustable with respect to each of the positions of the reclining chair.

OBJECTS OF THE INVENTION

Therefore, it is an object of this invention to provide a moveable headrest for a reclining chair which avoids the aforementioned disadvantages of the prior art.

Another object of this invention is to provide a headrest for a reclining chair which is movable between a position adjacent to the back cushion of the chair and a position remote from the back cushion.

A further object of this invention is to provide a moveable headrest for a reclining chair which is upholstered directly to the back cushion of the reclining chair such that it is automatically adjustable with respect to each of the positions of the reclining chair.

Another object of this invention is to provide a moveable headrest for a reclining chair which comfortably supports the user's neck.

An additional object of this invention is to provide a moveable headrest for a reclining chair which is inexpensive to manufacture.

Still another object of this invention is to provide a moveable support member for moving a reclining chair headrest which urges the headrest into a comfortable position under the user's neck when the chair is reclined.

Various other objects, advantages, and features of the present invention will become readily apparent from the ensuing detailed description, and the novel features will be particularly pointed out in the appended claims.

SUMMARY OF THE INVENTION

In accordance with the present invention, a reclining chair is provided having a moveable headrest which is automatically adjustable with respect to each of the positions of the reclining chair to comfortably support the user's head and neck. The headrest is a semi-cylindrical upholstered cushion which is sewn along its lower edge to the front edge of the back cushion of the reclining chair. As such, the headrest is adapted to move between a position wherein the headrest lies generally flat rearwardly of the back and a position wherein the headrest swings forwardly and automatically adjusts into a position to comfortably support the user's neck.

In accordance with another aspect of the present invention, a moveable rear support member coordinates movement of the headrest between the positions of the chair. As the chair is initially reclined, the top edge of the rear support member pushes the headrest upwardly from its generally flat position. As the chair is further reclined, a camming surface along the front surface of the moveable support member further pivots the headrest until it is generally in the plane of the back cushion. In the final reclined position, the camming surface of the rear support member urges the headrest further forwardly such that it is comfortably supported under the user's neck.

BRIEF DESCRIPTION OF THE DRAWINGS

The following detailed description, given by way of example, will best be understood in conjunction with the accompanying drawings in which.

DETAILED DESCRIPTION OF A PREFERRED EMBODIMENT

Figure 1:
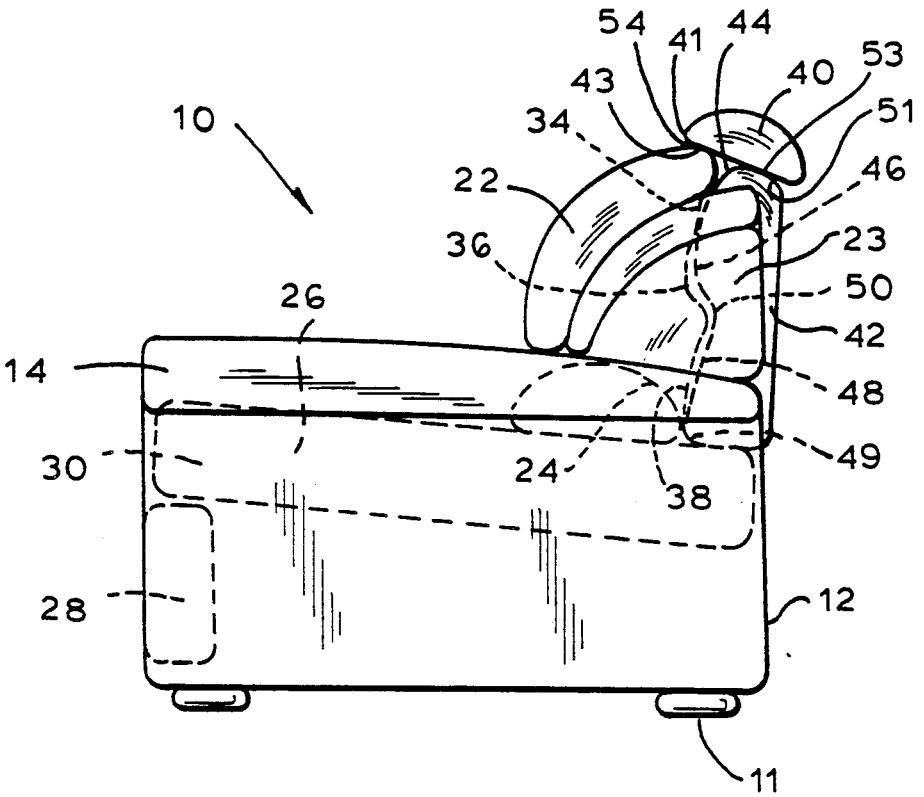
FIGS. 1 through 5 are side elevational views depicting the sequence of movement of the reclining chair of this invention.

Referring now to the drawings, wherein like reference numerals are used throughout, and in particular to FIGS. 1 through 6 thereof, there is illustrated a preferred embodiment for a reclining chair 10. In order to move the chair easily to any desired location, the chair is supported by a plurality of roller coasters 11. The reclining chair includes a stationary frame 12 having two sides 14 and 16 with their upper ends arranged as armrests 18 and 20, respectively. A back cushion 22 and a seat cushion 26 are pivotally mounted between the sides 14 and 16 with the seat cushion being supported in front of the back cushion 22. In order to further support the back cushion 22, a pair of spaced apart upstanding frame members 23 and 25 are arranged on opposite sides thereof.

Figure 2:
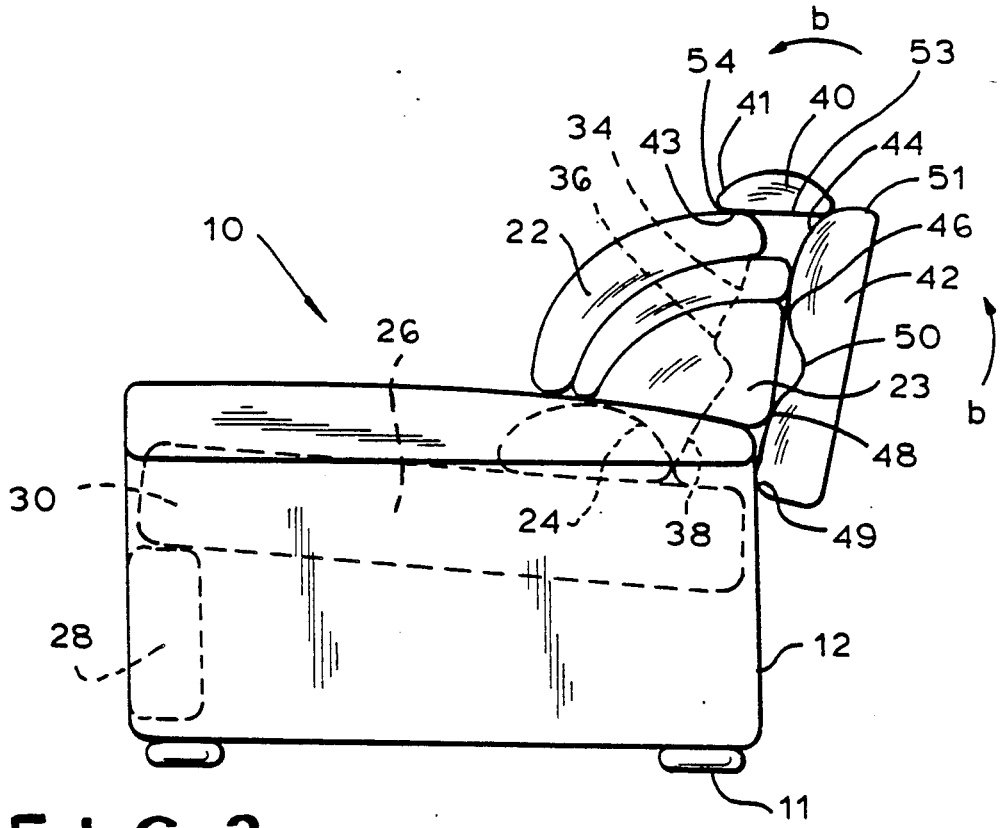
Figure 3:
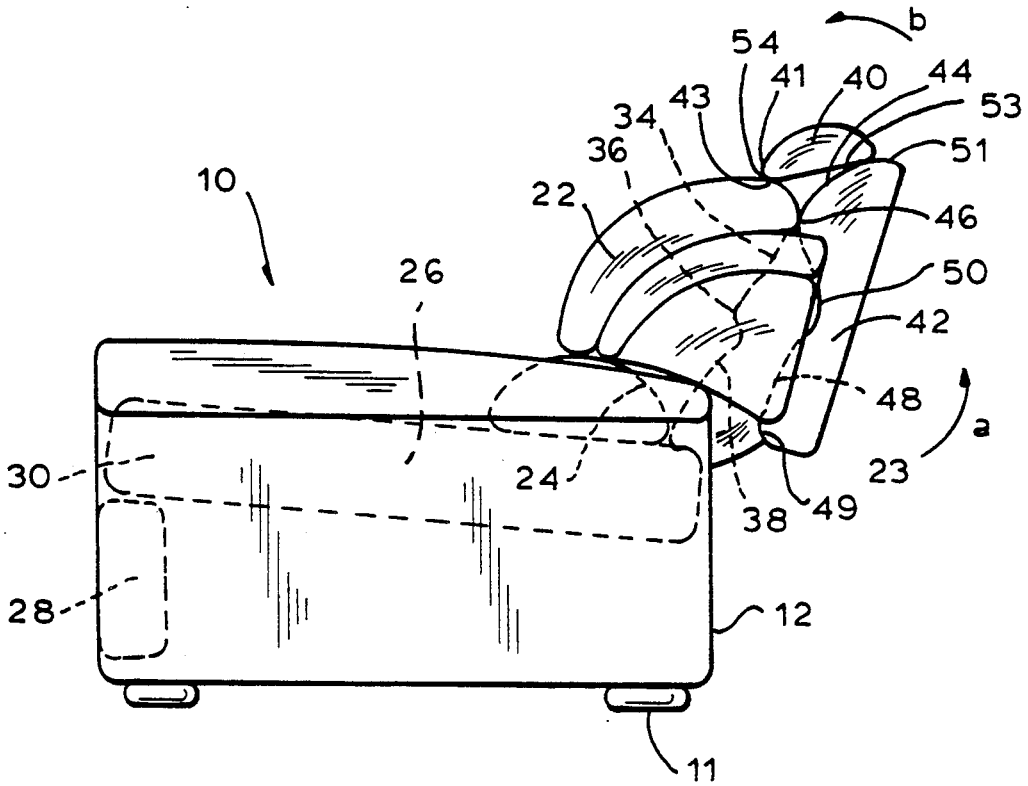
Figure 4:
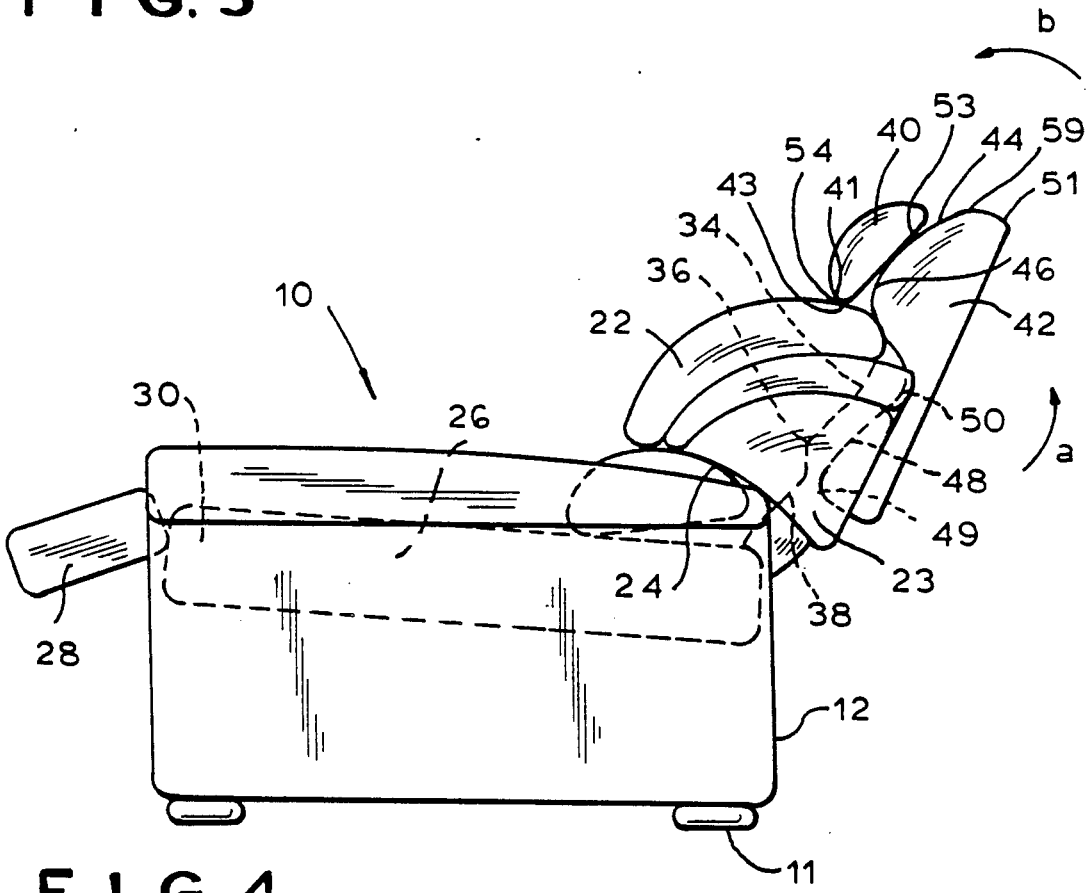
Figure 5:
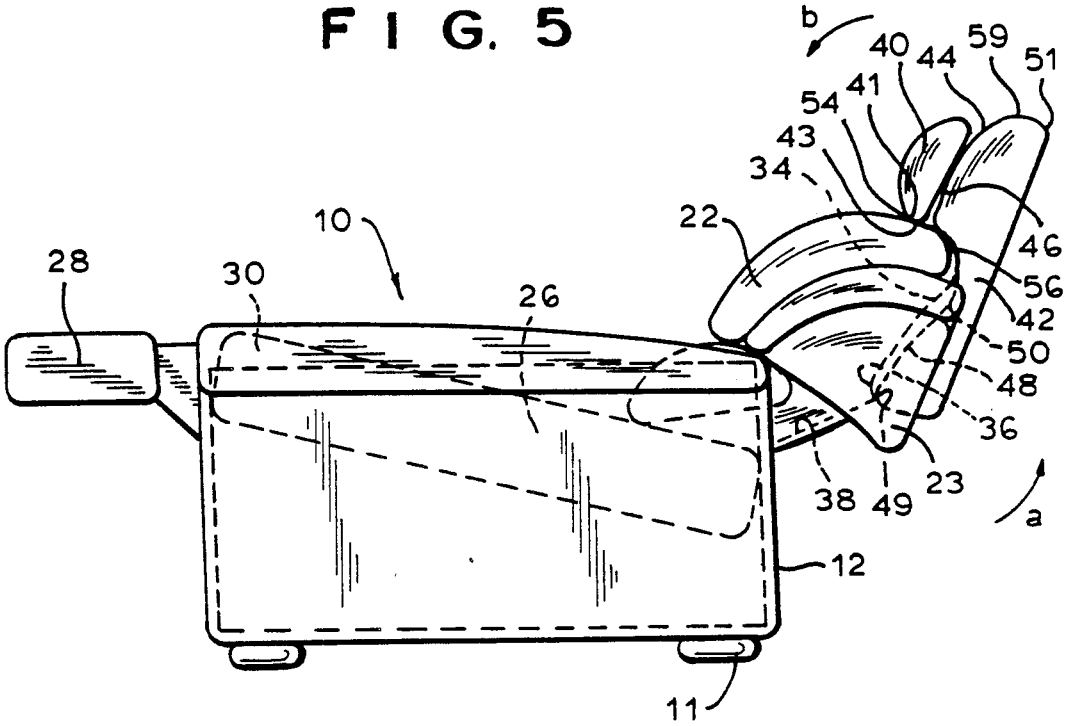
Figure 6:
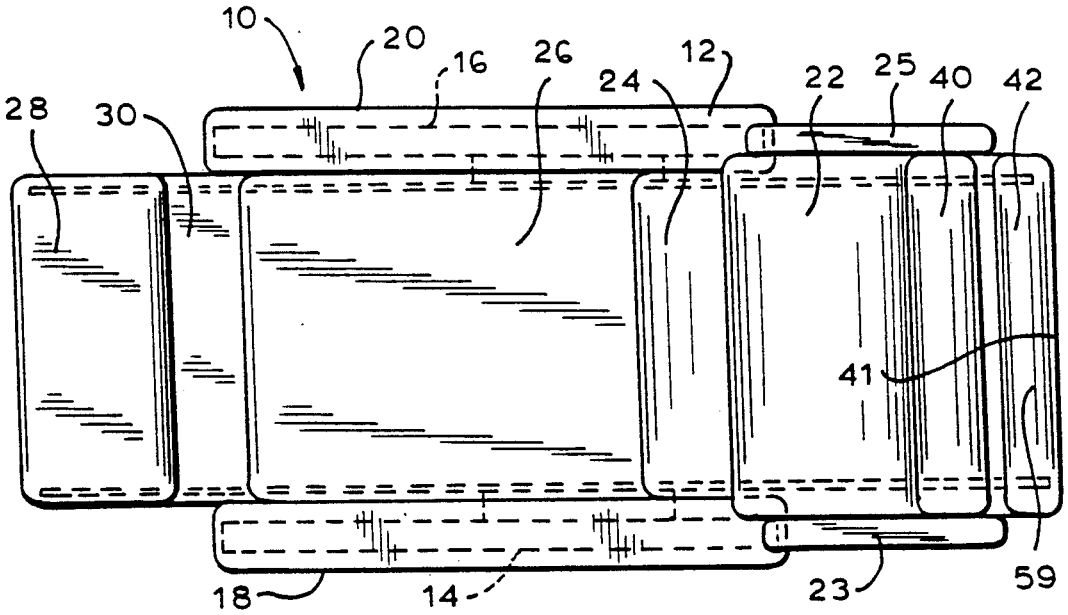
FIG. 6 is a top elevational view of the reclining chair in its reclined position as shown in FIG. 5.

As is typical in a reclining chair, the back cushion 22 is adapted to move between a generally upright position, as is shown in FIG. 1, and a reclined position, as is shown in FIG. 5, wherein the back cushion 22 has a lower portion 24 which is pivoted forwardly. As the chair is reclined, the seat cushion is titled upward toward the footrest 28 such that the user's legs are upwardly inclined, and thus, comfortably supported. The footrest 28 is interconnected to the front 30 of the seat 26 by a known mechanical linkage 70 (see FIG. 7) such as described in U.S. Pat. No. 3,847,430. The footrest 28 is adapted to hang vertically downward in front of the seat, as is shown in FIGS. 1–3, and alternatively, to swing upwardly in front of the seat 26 in the reclined position of the chair, as is shown in FIGS. 4 and 5. In this reclined position, the footrest is positioned generally in the horizontal plane of the seat cushion to reliably support the user's feet.

In accordance with one of the general objects of this invention, a headrest 40 is provided which is automatically adjustable with respect to each of the positions of the reclining chair. As shown in FIG. 1, the headrest 40 is a semi-cylindrical upholstered cushion which is sewn along its lower edge 41 to the top front edge 43 of the back cushion of the recliner chair. In the normal generally upright position of the chair, the headrest 40 lies generally flat rearwardly of the back cushion 22 and remote therefrom. When the chair is reclined, the headrest 40, however, is pivoted forwardly into generally the vertical plane of said back cushion upwardly therefrom such that the headrest is positioned directly under the user's neck to provided support therefrom.

In order to automatically coordinate movement of headrest 40, a movable rear support member 42 is operatively connected to the back cushion 22. The front surface 44 of the moveable rear support member 42 is contoured to move the headrest in a predetermined manner and to support the back cushion in the normal upright and reclined positions of the chair. As shown in FIGS. 1 through 5, the front surface 44 includes a camming surface 46 of generally arcuate shape and a downwardly depending inclined surface 48 terminating at a stop surface 49. An undulation 50 is provided between the camming surface 46 and the inclined surface 48.

The sequence of movement of the moveable support member is illustrated in FIGS. 1 through 5. As shown in FIG. 1, in the lower position of the moveable support member, the top edge 51 thereof supports the bottom surface 53 of the headrest 40 and restrains the headrest from pivoting further downwardly. Additionally, the front surface 44 of the support member is in a closely abutting relationship to the rear surface 32 of the back cushion 22 to provide additional support for the back cushion when the reclining chair is in its upright position. That is, the upper inclined surface 34 of the back closely abuts against the camming surface 46 of the rear support member 42. The stepped surface 36 of the back cushion abuts against the undulation 50 of the rear support member. Further, the inclined lower surface 38 of back cushion 22 closely abuts against the lower inclined surface 48 of the moveable support member.

If an individual begins to recline in the chair (i.e. begins to lean back in the chair), the movable rear support member is moved from its lower position shown in FIG. 1 to that shown in FIG. 2. In that position, the moveable rear support member 42 is moved remote from the back cushion 22 rearwardly and upwardly thereof in the direction of arrow a (FIG. 3). The top edge 51 of rear support member 42 pushes the bottom surface 53 of headrest 40 upwardly and pivots the headrest about pivot point 54 in the direction of arrow b. The pivot point 54 is defined by the point of sewing of the lower edge 41 of the headrest to the front edge 43 of the back.

As the chair is further reclined, the bottom surface 53 of headrest 40 rides on the arcuate camming surface 46 of rear support member 42 and thereby pivots the headrest further about stitch line 54 (see FIG. 3). As the rear support member 42 is moved further upwardly, the headrest is urged further forwardly generally into the vertical plane of the back cushion 22 (see FIG. 4).

In the final, upward position of the rear support member 42 (see FIGS. 5 and 6), the camming surface 46 urges the headrest 26 further forwardly such that the headrest is automatically adjusted into a position comfortably under the user's neck. By varying the degree of angular displacement of the chair, a user of any height may comfortably position headrest 40 under his or her neck. A top portion 59 of the front surface of the rear support member is exposed upwardly of the headrest 40 to support the user's head.

In the final position, the contour of the front surface of the rear support member also provides additional support to the back cushion. As shown in FIG. 5, the undulation 50 of rear support member 42 is capable of abutting engagement with the abutment surface 56 of the rear surface 32 of the back located above the upper inclined surface 34. Additionally, the stop surface 49 along the lower edge of rear support member 42 is capable of abutting engagement with the stepped surface 36 of the rear surface of the back cushion. Further, the inclined surface 48 of the rear support member between the undulation 50 and stop surface 49 rests against the upper inclined surface 34 of the back cushion 22. Thus, the undulation 50, stop surface 49 and inclined surface 48 of the rear support member 42 cooperate with the abutment surface 56, stepped surface 36 and inclined surface 34 of the back cushion, respectively, to provide rigid support for the back when the chair is in its reclined position.

Figure 7:
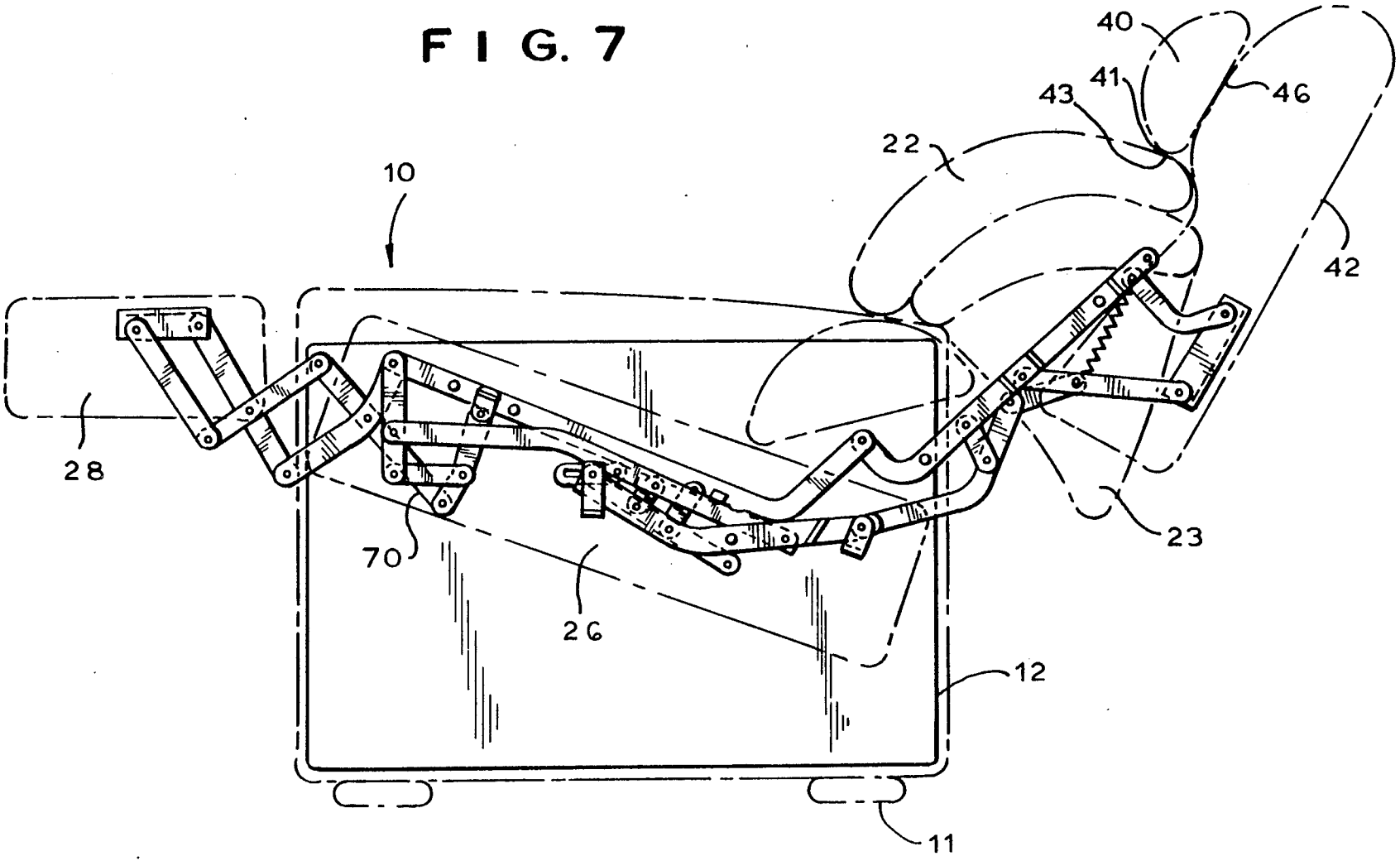
FIG. 7 is a side elevational view, similar to FIG. 5 showing the position of the linkage mechanism 70 for the reclining chair when it is in its reclined position.

As is shown in FIG. 7, a linkage mechanism 70 is illustrated providing for coordinated movement of the back cushion 22, seat 26, footrest 28 and rear support member 42. The type of linkage mechanism illustrated in FIG. 7 to move the chair between its upright and reclined positions is well known in the art and may be of the type disclosed and illustrated in U.S. Pat. No. 3,847,430.

While the present invention has been particularly shown and described with reference to a preferred embodiment, it will be readily apparent to those of ordinary skill in the art that various changes and modification may be made therein without departing from the spirit and scope of the invention. It is intended that the appended claims be interpreted as including the foregoing as well as various other changes and modifications.

What is claimed is:

1. A reclining chair comprising a stationary frame having two sides spaced apart, a back pivotally mounted in said frame and adapted to pivot between an upright position and a reclined position, said back having an upper front edge and a lower portion adapted to swing forward as the back moves to said reclined position, a seat supported from said sides in front of said back, a footrest mounted in front of said seat for movement between a vertical position in front of said seat and an upper generally horizontal position in front of said seat when said back pivots from its upright position to its reclined position, and a separate headrest sewn directly to said front edge of said back and adapted to move between a first position, wherein said headrest lies generally in a horizontal plane rearwardly of said back, and a second position, wherein said headrest swings forwardly into generally the vertical plane of said back upwardly of said back such that said headrest is positioned comfortably under the neck of the user, said headrest moving from its first to second position when said back pivots from its upright position to its reclined position.

2. The reclining chair of claim 1 including movable rear support member means operatively connected to said back for interacting with said headrest to move said headrest between its first and second positions when said back moves between its upright and reclined positions.

3. The reclining chair of claim 2 wherein said rear support member is movable from a lower position, wherein said rear support member closely contours the rear surface of said back, to a plurality of intermediate positions.

4. The reclining chair of claim 3 wherein one of said plurality of intermediate positions is a first intermediate position wherein the top edge of said rear support member pushes the headrest upwardly.

5. The reclining chair of claim 3 wherein one of said plurality of intermediate positions is a second intermediate position wherein the front surface of said rear support member interacts with said headrest to move said headrest into generally the vertical plane of said back.

6. The reclining chair of claim 5 wherein, in said second intermediate position, the contoured front surface of said rear support member acts as a camming surface.

7. The reclining chair of claim 3 wherein said rear support member is movable from said plurality of intermediate positions to a final upward position, wherein the front surface of said rear support member urges said headrest further forwardly such that said headrest is positioned comfortably under the user's neck.

8. The reclining chair of claim 7 wherein, in said final position, an undulation of said rear support member is capable of abutting engagement with an abutment surface of said back, and a stop surface of said rear support member is capable of abutting engagement with a stepped surface of said rear surface of said back, said undulation and said stop surface cooperating with said abutment surface and said stepped surface, respectively, to retain the chair in its reclined position.

9. The reclining chair of claim 8 wherein, in said final position, an inclined surface of said rear support member between said undulation and said stop surface rests against the rear surface of said back to provide rigid support for said back when the chair is in its reclined position.

10. The reclining chair of claim 1 wherein said headrest is generally pillow-shaped.

11. A reclining chair comprising a stationary frame having two sides spaced apart, a back pivotally mounted in said frame and adapted to pivot between an upright position and a reclined position, said back having an upper front edge and a lower portion adapted to swing forward as the back moves to said reclined position, a seat supported from said sides in front of said back, a footrest mounted in front of said seat for movement between a vertical position in front of said seat and an upper generally horizontal position in front of said seat when said back pivots from its upright position to its reclined position, and a separate headrest sewn directly to said front edge of said back and adapted to move between a first position, wherein said headrest lies generally in a horizontal plane rearwardly of said back, and a second position, wherein said headrest swings forwardly into generally the vertical plane of said back upwardly of said back such that said headrest is positioned comfortably under the neck of the user, said headrest moving from its first to second position when said back pivots from its upright position to its reclined position; and movable rear support member means operatively connected to said back for interacting with said headrest to move said headrest between its first and second positions when said back moves between its upright and reclined positions; said rear support member being movable from a lower position, wherein said rear support member closely contours the rear surface of said back to a plurality of intermediate positions; said lower position of the rear support member corresponding to the upright position of said back; one of said plurality of intermediate positions of said support member being a position wherein the front surface of said rear support member interacts with said headrest to move said headrest into generally the vertical plane of said back and wherein, in said second intermediate position, the contoured front surface of said rear support member acts as a camming surface; said camming surface being of a generally arcuate shape.

12. A reclining chair comprising a stationary frame having two sides spaced apart, a back pivotally mounted in said frame and adapted to pivot between an upright position and a reclined position, said back having an upper front edge and a lower portion adapted to swing forward as the back moved to said reclined position, a seat supported from said sides in front of said back, a foot rest mounted in front of said seat for movement between a vertical position in front of said seat and an upper generally horizontal position in front of said seat when said back pivots from its upright position to its reclined position, a separate headrest sewn directly to said front edge of said back and adapted to move about the sewn connection between the headrest and back between a first position, wherein said headrest lies generally in a horizontal plane rearwardly of said back, and a second position, wherein said headrest swings forwardly into generally the vertical plane of said back upwardly of said back, said headrest moving from its first to its second position when said back pivots from its upright to its reclined position, and a movable rear support member means operatively connected to said back for interacting with said headrest to move said headrest between its first and second positions when said back moves between its upright and reclined positions, said rear support member being movable between a lower position, wherein said rear support member closely contours the rear surface of said back, a first intermediate position, wherein the top edge of the rear support member pushes the headrest upwardly, a second intermediate position, wherein the front surface of said rear support member moves the headrest generally into the vertical plane of said back, and a final, upward position, wherein the front surface of said rear support member urges said headrest further forwardly such that said headrest is positioned comfortably under the user's neck; said lower position of the support member corresponding to the upright position of the back and said final upward position of the support member corresponding to the reclined position of the back.

13. The reclining chair of claim 12 wherein, in said second intermediate position, the contoured front surface of said rear support member acts as a camming surface.

14. The reclining chair of claim 13 wherein said camming surface is of a generally arcuate shape.

15. The reclining chair of claim 12 wherein, in said final position, an undulation of said rear support member is capable of abutting engagement with an abutment surface of said back, and a stop surface of said rear support member is capable of abutting engagement with a stepped surface of said rear surface of said back, said undulation and said stop surface cooperating with said abutment surface and said stepped surface, respectively, to retain the chair in its reclined position.

16. The reclining chair of claim 15 wherein, in said final position, an inclined surface of said rear support member between said undulation and said stop surface rests against the rear surface of said back to provide rigid support for said back when the chair is in its reclined position.

17. A reclining chair comprising a stationary frame having two sides spaced apart, a back pivotally mounted in said frame and adapted to pivot between an upright position and a reclined position, said back having an upper front edge and a lower portion adapted to swing forward as the back moves to said reclined position, a seat supported from said sides in front of said back, a footrest mounted in front of said seat for movement between a vertical position in front of said seat and an upper generally horizontal position in front of said seat when said back pivots from its upright position to its reclined position, a separate headrest sewn directly to said front edge of said back and adapted to move about the sewn connection between the headrest and back between a first position, wherein said headrest lies generally in a horizontal plane rearwardly of said back, and a second position, wherein said headrest swings forwardly into generally the vertical plane of said back upwardly of said back, said headrest moving from its first to its second position when said back pivots from its upright position to its reclined position, and a rear support member movable between a rest position corresponding to the upright position of the back, wherein said headrest is in its first position, and a final, upright position corresponding to the reclined position of the back, wherein said headrest is in its second position and an undulation of said rear support member is capable of abutting engagement with an abutment surface of said back, and a stop surface of said rear support member abuts against a stepped surface of said rear surface of said back, said undulation and said stop surface cooperating with said abutment surface and said stepped surface respectively, to retain the chair in its reclined position.

18. The reclining chair of claim 17 wherein, in said final position, an inclined surface of said rear support member between said undulation and said stop surface rests against the rear surface of said back to provide rigid support for said back when the chair is in its reclined position.

* * * * *